United States Patent [19]

Grundy

[11] 3,946,972

[45] Mar. 30, 1976

[54] SIMPLIFIED CAB SIGNAL RECEIVER CIRCUIT

[75] Inventor: Reed H. Grundy, Murrysville, Pa.

[73] Assignee: Westinghouse Air Brake Company, Swissvale, Pa.

[22] Filed: May 8, 1975

[21] Appl. No.: 575,630

[52] U.S. Cl. ..... 246/34 CT; 246/182 C

[51] Int. Cl.[2] ..... B61L 21/08

[58] Field of Search ..... 246/34 R, 34 CT, 63 R, 246/63 C, 167 R, 182 C

[56] References Cited

UNITED STATES PATENTS 3,868,075 2/1975 Blazek ..... 246/34 CT

*Primary Examiner*—Trygve M. Blix
*Assistant Examiner*—Reinhard J. Eisenzopf
*Attorney, Agent, or Firm*—R. W. McIntire, Jr.

[57] ABSTRACT

This invention covers train cab signal equipment for receiving frequency modulated rail code signals which, when decoded, provide a zone speed control signal which the railway train traversing the track rail must obey in order to proceed at a safe speed. The invention includes a signal limiter circuit which prevents the signal supplied to the several code frequency responsive networks in the decoder unit from exceeding a predetermined maximum value in order to assure a welldefined frequency bandwidth to which respective code filters in the frequency responsive networks are sensitive, so that only a single network is responsive to any given code signal. In addition, the limiter circuit supplies the respective frequency responsive networks with a code signal whose amplitude is proportional to rail current so long as the code signal is below the maximum level set by the limiter. This permits a level detector associated with each code filter to monitor the code signal received for minimum level detection in order to assure that the rail current code signal is a valid code signal.

10 Claims, 4 Drawing Figures

SIMPLIFIED CAB SIGNAL RECEIVER CIRCUIT

BACKGROUND OF THE INVENTION

The present invention relates to cab signal equipment for a railway train and more particularly to a limit circuit thereof that is capable of producing an output signal proportional to rail current within a predetermined amplitude range.

In certain types of signal and communication systems used in rapid transit operations, it is common practice to employ cab signal receiving and decoding units to control train speeds within different track sections or restricted speed areas as the train moves along its route of travel. Generally the cab signals are conveyed to the train from the wayside in the form of frequency coded carrier waveforms. That is, a predetermined carrier frequency is selectively transmitted at different code rates corresponding to the desired speed at which the train is permitted or authorized to travel along a particular section of trackway. In practice, these coded carrier signals are normally fed to the track rails and are picked up by means of inductive coils mounted on the front end of the train. These induced frequency modulated signals are then filtered, amplified, demodulated, level detected and limited prior to being fed to several code frequency responsive networks comprising the decoding unit. Relay means responsive to the respective code frequency responsive networks control switches in brake control equipment shown and fully described in copending application Ser. No. 388,372, now U.S. Pat. No. 3,890,577. It will be understood, of course, that the number of these code frequency responsive networks is dependent upon the number of discrete speed levels provided for in the particular cab signal receiver equipment.

A block diagram of a state-of-the-art cab signal system is shown in FIG. 1 of the drawings where a cursory review will make it evident that a level detector circuit is employed in both the receiver and decoder units of the equipment.

In the receiver unit, the level detector functions to assure that the code signals received by the train are in fact valid signals transmitted via the rail and accordingly are not spurious or unwanted signals induced in the rail from a signal transmitted along an adjacent track section, for example. Experience has shown that rail current signals below a certain amplitude that is determined from a given multiple of the transmitted frequency may be considered invalid signals to be rejected. Because of the requirement that this level detector be of a "vital" design, i.e., one in which any malfunction of a critical component will fail to cause an output signal, a rather complex circuit has evolved, as shown in U.S. Pat. No. 3,614,466, which clearly shows and describes this circuit. In addition to the high cost of developing and building such a complex circuit, further expense results due to servicing requirements to adjust and maintain the circuit properly.

In contrast, the level detectors in the decoder unit monitor their respective code filter outputs to further assure that the signal amplitude falls within the frequency response bandwidth of the respective code filter with which each is associated, and accordingly are of considerably less complicated design than the level detector used in the receiver unit.

SUMMARY OF THE INVENTION

It is one object of the present invention, therefore, to eliminate the costly level detector presently used in the receiver unit of the state-of-the-art system of FIG. 1.

In order to accomplish the above object, however, it has been found necessary to modify the cab signal system in order to provide the decoder unit level detector with a signal that is proportional to rail current so that this level detector can assume the function heretofore provided by the level detector in the receiver unit.

At this point, mention should be made of the fact that the level detector in the receiver unit, as described in aforementioned U.S. Pat. No. 3,614,466, employs a switching type amplifier circuit that produces a bi-stable output signal, i.e., an output signal that is either one of two discrete levels, depending upon the input rail current alternation or code signal being above a predetermined minimum rail current corresponding to a valid rail current code signal. This bi-level signal is then fed to a limiter circuit, which functions to clip the signal at a predetermined amplitude in order to maintain discrete bandpass regions of the different code frequencies. In simply attempting to eliminate the level detector in the receiver unit, it should be appreciated that the limiter circuit of FIG. 1 would switch to a "high" level output in response to any rail current signal level within the limit set by the limiter circuit, so that the decoder unit would have no way of detecting whether the rail current code signal received is actually a valid signal or not.

It is therefore another object of the invention to provide a limiter circuit which displays an output proportional to rail current up to a predetermined level above which the output remains at a constant amplitude.

In achieving the aforementioned objects, a limiter circuit comprising a transistor switch arranged in an emitter-follower configuration is provided with a regulated reference voltage supply at its collector electrode, which establishes the saturation level of the transistor. The emitter electrode thus produces a signal proportional to the rail current code signal at its base electrode until the rail current exceeds the saturation level or reference voltage supply at the collector, thus limiting the maximum amplitude of the output. In limiting the maximum output of the limiter circuit to a predetermined value, discrete ranges of frequency response are established so that only a single filter network is responsive to a given code signal.

The frequency of this limited code signal is sensed by a particular one of a plurality of frequency responsive code filters, while a level detector associated therewith monitors the filter output signal to assure that it is at least a predetermined minimum amplitude corresponding to a valid rail current code signal.

The manner in which this limiter circuit functions to allow the decoding network level detector to monitor minimum rail current code signals so as to permit elimination of the costly receiver level detector will become more readily apparent from the following more detailed explanation when taken in conjunction with the accompanying drawings in which.

DESCRIPTION AND OPERATION

Figure 2:
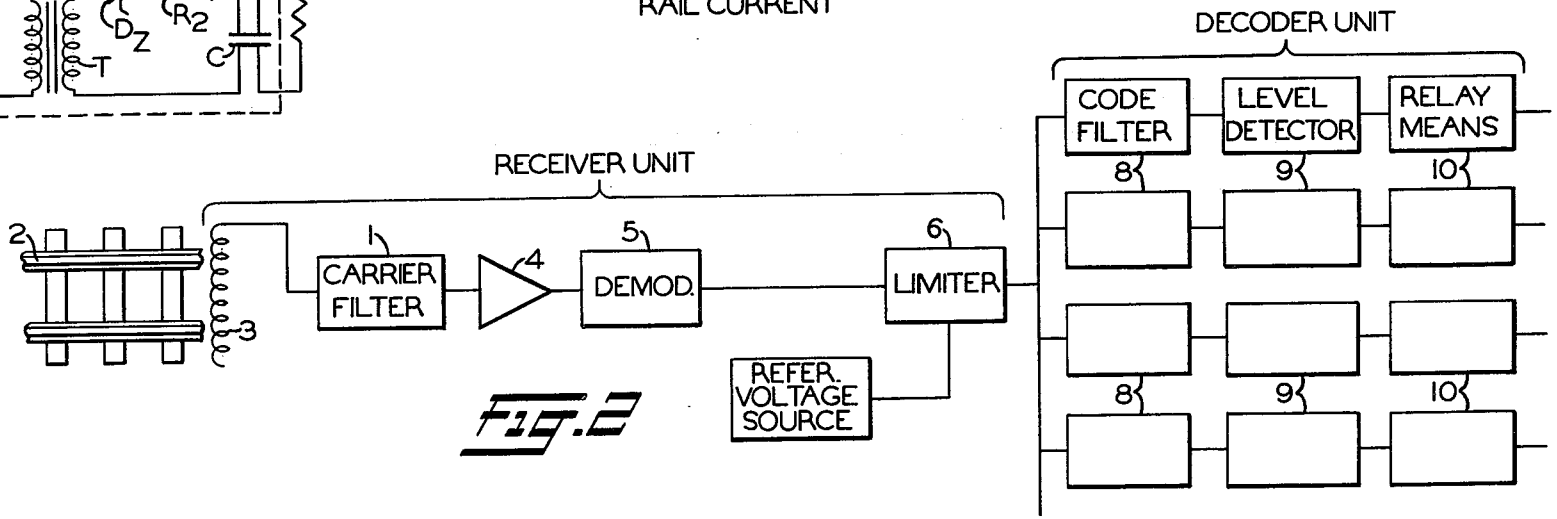
FIG. 2 is a block diagram of the locomotive cab signaling system when modified according to the invention.

Referring now to the drawings and particularly to FIG. 2, a filter network represented by block 1 may comprise a tuned circuit selected to pass a predetermined carrier frequency waveform corresponding to the carrier signal frequency on which a coded track signal is transmitted along the track rails 2 and received by induction coils 3 carried by the train. A suitable amplifier 4 amplifies the coded carrier signal conducted via filter 1 at the desired signal level and feeds the signal to a demodulator network 5. The carrier signal on which the code signal is transmitted is removed by a suitable method of demodulation, leaving the coded d.c. waveform. The filter 1, amplifier 4 and demodulator 5 are all conventional circuits the details of which are not deemed necessary for a complete understanding of the present invention.

Figure 3:
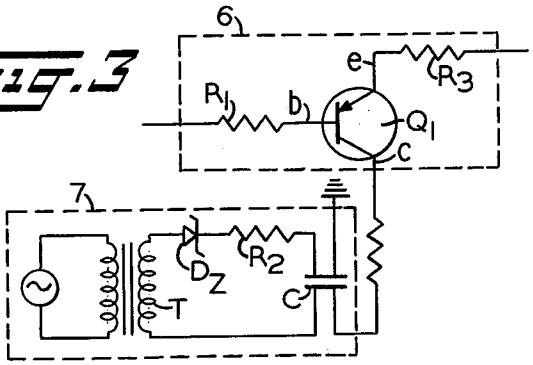
FIG. 3 is a circuit schematic of the limiter block shown in FIG. 2.

The d.c. code waveform remaining after demodulation is fed to a limiter circuit represented by block 6. As shown in FIG. 3, this circuit comprises a PNP type transistor Q1 whose base electrode b is subject to the d.c. code waveform supplied from demodulator 5 via a current limiting resistor $R_1$. The collector electrode c is connected to a four-terminal capacitor C of a reference voltage source represented in FIG. 2 by block 7. The circuit comprising this reference voltage source is fully shown and described in copending Pat. application Ser. No. 417,113. Briefly, this circuit is powered by a suitable a.c. source, which may be coupled to its supply terminals via a conventional transformer T. A zener diode $D_z$ rectifies the a.c. voltage, which is fed via a current-limiting resistor $R_2$ to capacitor C. The level of charge attained by capacitor C is approximately equal to one-half the quantity of the zener breakdown voltage less the voltage drop across the zener diode and is maintained as a constant or regulated d.c. voltage source.

Figure 4:
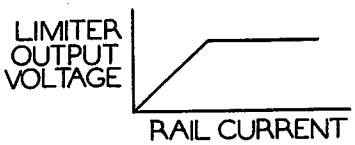
FIG. 4 is a curve representing the function of the limiter block of FIG. 2.

The emitter electrode e of transistor Q1 comprises the output of limiter block 6 and reflects, by way of resistor $R_3$, a signal that is proportional to the demodulated code signal supplied to base electrode *b* for signals having a voltage magnitude equal to or less than the reference voltage level to which capacitor C is charged. When the base voltage of transistor Q1 exceeds a value corresponding to the voltage supplied to collector C via resistor $R_1$, the transistor saturates and accordingly maintains a constant level output corresponding in magnitude to the regulated reference voltage in response to further increases in base voltage. It will be appreciated, therefore, that this regulated reference voltage may be selected to limit the amplitude of the code signal and accordingly achieve the desired degree of bandwidth resolution necessary to obtain good code frequency selectivity, as will be apparent hereinafter. Furthermore, amplitudes of the rail current code signal below this limit level result in proportional output signals, which is of considerable importance in eliminating the first level detector shown in the state-of-the-art arrangement of FIG. 1. The curve shown in FIG. 4 represents this rail current to output voltage relationship provided by limiter 6 in conjunction with the reference voltage source 7.

The code signal at the output of limiter block 6 is connected to a code filter block 8 in each of a plurality of code frequency responsive networks comprising the decoding unit of the cab signal equipment. Each of these code frequency responsive networks are similar in that they include, in addition to code filter block 8, a level detector represented by block 9 and relay means represented by block 10. Each of the code filters 8 may comprise a conventional tuned circuit designed to achieve maximum frequency response at different selected code frequencies. It will be appreciated therefore that only one of the respective frequency responsive networks will be sensitive to any given code signal. Furthermore, the level detector 9 in each of these networks is capable of monitoring the code signal passed by the code filter for minimum level to assure that the code signal received from the rail current is in fact a valid code signal and not a spurious signal generated by inductive coupling from an adjacent track, for example. The fact that the limiter 6 maintains proportionality between the rail current and the output supplied to the decoder unit code filters 8 permits this level detector 9 to perform the function of monitoring the code signal integrity heretofore provided by the level detector in the receiver unit of the state-of-the-art cab signal equipment shown in FIG. 1. As long as the signal exceeds a predetermined minimum amplitude below which the code signals are deemed invalid, the code signal is passed by the level detector in whichever frequency responsive network is sensitive to the code signal received. This level detected signal is then fed to the corresponding relay means 10, which operates to provide a speed restrictive control signal, for example, corresponding to the coded speed zone signal received from the track rails by the cab signal equipment.

Figure 1:
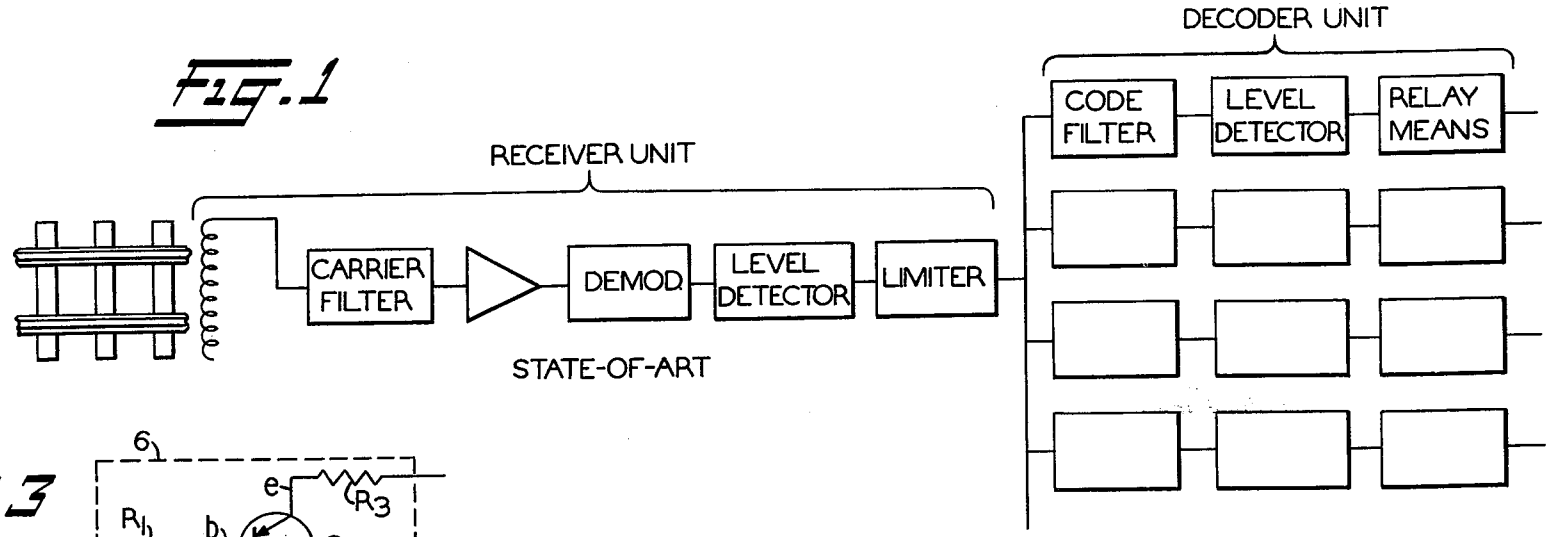
FIG. 1 is a block diagram of a state-of-the-art locomotive cab signaling system.

It will now be apparent in comparing the cab signal equipments shown in FIGS. 1 and 2 that the functions provided according to the present invention are identical to that of the state-of-the-art system without requiring the complex level detector used in the receiver unit of the FIG. 1 system. Elimination of this complex level detector enhances the cost of the cab signal equipment without compromising its functional capability or reliability and therefore constitutes a step forward in the art.

Having now described the invention, what I claim as new and desire to secure by Letters Patent, is:

1. A cab speed signaling system for a railway train traveling along a section of track rails via which speed code signals are transmitted according to the desired train speed on said track section, said signaling system comprising:

a. receiver means for receiving the transmitted speed code signals and including signal limiter means for modifying the received speed code signal such that the amplitude thereof is proportional to the track current of said transmitted speed code signals and, b. decoder means including a plurality of different frequency responsive networks for selecting said modified speed code signals, each frequency responsive network comprising:

i. relay means for establishing a desired train speed command;

ii. filter means sensitive to said modified speed code signals within a predetermined frequency range for effecting operation of said relay means; and iii. level detector means for monitoring the amplitude of said modified speed code signal sensed by said filter means so as to interrupt operation of said relay means in the event the amplitude of said received speed code signal is less than a predetermined level corresponding to the minimum amplitude of said transmitted speed code signals.

2. A cab signaling system as recited in claim 1, further characterized in that said signal limiter means prevents the proportional signal amplitude of said modified signal from exceeding a predetermined level so that the frequency response characteristic of different speed code signals is such as to assure a distinct bandwidth frequency corresponding to said predetermined frequency range to which each of said respective filter means is sensitive.

3. A cab signaling system as recited in claim 2, wherein said signal limiter means comprises:

a. proportional amplifier means for providing said modified speed code signals as a linear function of said received speed code signals; and b. means for providing a regulated source of d.c. voltage, said proportional amplifier being supplied by said regulated source of d.c. voltage, which establishes the saturation level of said proportional amplifier to limit the amplitude of said modified speed code signal at said predetermined level.

4. A cab signaling system as recited in claim 3, wherein said proportional amplifier means comprises a transistor amplifier having a base electrode to which said received speed code signal is connected, a collector electrode to which said source of d.c. voltage is connected and an emitter electrode for providing said modified speed code signals.

5. A cab signaling system as recited in claim 3, wherein said means for providing a regulated source of d.c. voltage comprises:

a. a transformer having a primary and secondary winding;

b. a source of a.c. voltage connected to said primary winding;

c. a capacitor having first and second pairs of terminals, one of said first pair of terminals being connected to one end of said secondary winding;

d. a zener diode having one electrode connected to the other end of said secondary winding;

e. a resistor connected between the other electrode of said zener diode and the other of said first pair of terminals of said capacitor, said second pair of terminals of said capacitor having a constant d.c. voltage developed thereacross and being connected to said proportional amplifier to provide said regulated source of d.c. voltage.

6. A cab signaling system as recited in claim 1, further characterized in that said transmitted speed code signals comprise a carrier signal modulated according to a predetermined code rate corresponding to the desired train speed.

7. A cab signaling system as recited in claim 6, further characterized in that said frequency modulated speed code signals transmitted via the track rails are inductively coupled to said receiver means.

8. A cab signaling system as recited in claim 7, wherein said receiver means further comprises frequency responsive carrier filter means sensitive only to the frequency of said carrier signal by which said speed code signals are transmitted.

9. A cab signaling system as recited in claim 8, wherein said receiver means further comprises demodulator means for removing said carrier signal from said received speed code signal.

10. A cab signaling system as recited in claim 9, wherein said receiver means further comprises amplifier means for providing said received speed code signals at a level required by said demodulator means.

* * * * *